US005921481A

United States Patent [19]

Nakamura et al.

[11] Patent Number: 5,921,481

[45] Date of Patent: Jul. 13, 1999

[54] AIR CLASSIFIER WITH SPECIFIED TRUNCATED CONE-LIKE BREATHER PIPE

[75] Inventors: Akihiro Nakamura, Osaka; Choichiro Tanigawa, Toyonaka; Yutaka Tsujishita, Takarazuka; Yasunori Sakuda, Suita, all of Japan

[73] Assignee: Minolta Co., Ltd., Osaka, Japan

[21] Appl. No.: 08/931,360

[22] Filed: Sep. 16, 1997

[30] Foreign Application Priority Data

Sep. 25, 1996 [JP] Japan ..... 8-252778

[51] Int. Cl.[6] ..... B02C 19/06

[52] U.S. Cl. ..... 241/39; 209/3; 241/79.1

[58] Field of Search ..... 209/3, 7; 241/79.1, 241/5, 39, 152.1, 76, 77, 78

[56] References Cited

U.S. PATENT DOCUMENTS 3,840,188 10/1974 Coombe et al. ..... 241/39
4,186,772 2/1980 Handleman ..... 241/39
4,361,290 11/1982 Francis ..... 241/79.1
5,035,364 7/1991 Escallon ..... 241/5

FOREIGN PATENT DOCUMENTS 6-154639 6/1994 Japan ..... 241/79.1
07080415 3/1995 Japan .

*Primary Examiner*—Mark Rosenbaum
*Attorney, Agent, or Firm*—McDermott, Will & Emery

[57] ABSTRACT

An air classifying system that can produce toner particles having a desired particle size is disclosed. The air classifying system contains a supplying pipe for supplying raw materials; a truncated cone-like breather pipe that has a ratio of minimal opening sectional area $S_1$ to a maximum opening sectional area $S_0$ being between 0.2 and 0.5, and an angle θ formed between axis and generatrix being between 10° and 35°; a classifying means for classifying the raw materials supplied through the supplying pipe; and an air flow-generating means for generating air-flow for transporting the raw materials in the classifying system.

16 Claims, 5 Drawing Sheets

AIR CLASSIFIER WITH SPECIFIED TRUNCATED CONE-LIKE BREATHER PIPE

BACKGROUND OF THE INVENTION

1. Field of the Invention

The present invention relates to an air classifier which can produce toner particles having a desired particle size.

2. Description of the Prior Art

In general, toner particles are produced through the steps of: mixing raw materials, melting and kneading the mixed materials, cooling the kneaded materials, and pulverizing the cooled materials, classifying the pulverized materials. Recently, toner particles are required to have small particle size and narrow particle-size distribution, as copying techniques for color images and digital images require very fine copy images.

In order to produce such toner particles as above mentioned, the classifying process needs particular classifying mechanism with high precision and high throughput capacity. The kneaded materials are conventionally classified by the following described pulverizing and classifying system, as shown in FIG. 4.

Roughly pulverized materials are introduced from an introduction port 1 after kneading. A blower 2 sucks air in pipeline to generate air-flow as shown by arrows. The roughly pulverized materials ride on the air flow, and are transferred to be put into an air-classifier main body 3. Toner particles larger than desired particle size are transferred to pulverizer 4, toner particles having desired particle size being transferred to cyclone 5, and super fine particles being transferred to bag-filter 6. As initially roughly-pulverized materials have a large particle size, almost all of the particles are transferred to the pulverizer 4. The toner particles finely pulverized in the pulverizer 4 are transferred again to the classifier main body 3 and subjected to the above mentioned classification. Toner particles as having a large particle size are repeatedly pulverized and classified until desired particle size is achieved. Then the toner particles having desired particle size are transferred to the cyclone 5 and collected. Super fine particles are transferred to the bag filter 6, although some toner particles transferred to the cyclone 5 contain super fine particles not removed in the classifier 3.

Toner particles collected in the cyclone 5 are accumulated on the upper part of double dampers 7. While the downside valve is closed, the upside valve is opened, so that toner particles fallen onto the downside valve. After the upside valve is closed, the down side valve is opened. Thereby, while the conditions of air flow inside the pipelines are maintained, toner particles can be taken out of the inside. Double dampers 8 are also arranged at the lower portion of the bag filter. Super fines collected in the bag filter 6 can be taken out of the inside while the air-flow conditions inside pipe lines are maintained.

An air-classifier, often used in the above system, may be exemplified by Dispersion Separator (DS type; made by Nippon Pneumatic MFG K.K.) utilizing swirling air, the sectional view of which is shown in FIG. 5. The reference number 21 shows a casing body. The reference number 22 shows a downside casing connected to a lower portion of the casing body 21, playing a role of a hopper 23 at the same time. A classifying area 24 is formed between the casing body 21 and the downside casing 22. A dispersion room 25 is formed at the upper port of the casing body 21. A raw material-supplying pipe 26, through which a mixture of primary air flow with pulverized materials are supplied, is connected to the peripheral upper port of the dispersion room. A conical center core 27 with high center portion is arranged at the lower port inside the dispersion room. Ring-shaped supplying grooves 28 are arranged at the lower peripheral edge portion of the center core 27. An exhaustion pipe 31 for fine particles is arranged at the bottom center of the classifying area. A conical separator core 29 with high center portion is arranged on the top of exhaustion pipe 31. Ring-shaped exhaustion grooves 30 for roughly pulverized particles are formed on the peripheral lower portion of the separator core 29. Secondary air flow inlets 32 and 33 for supplying secondary air flow are arranged on the lower peripheral wall of the classifying area. The secondary air flow disperses powder materials and accelerates swirling speed. The reference number 34 shows an air exhaustion pipe for introducing super fines to the bag filter (reference number 6 in FIG. 4). The reference number 35 shows an outlet for exhausting roughly pulverized particles to the pulverizer (reference number 4 in FIG. 4).

The characteristic of such a classifier as above mentioned is that the difference between centrifugal force and centripetal force working on the pulverized particles is utilized when the secondary air flow makes the pulverized particles revolve semi-freely in the classifying area, so that classifying conditions can be adjusted depending on particle size of particles to be classified. Throughput capacity is almost fixed by the capacity of the dispersion room and the classifying area or by the total flow of the first air flow and the secondary air flow.

However, there arises problems such as lowering of classifying efficiency the finer the toner particles, the higher is the adhering force of fine particles to toner particles in such an above mentioned pulverizing and classifying system of air-flow type. In particular, this problem is remarkable when an organic boron compound is used as a charge controlling agent. The cause of the problem is thought as follows. As the adhering force of fine particles to toner particles increases, dispersion of the fine particles becomes difficult. In particular, cohesion of particles becomes strong when organic boron compounds are used, resulting in difficulty of dispersion of fine particles. As a result, as aggregates go into the classifying area, in other words, as the aggregates can not be broken sufficiently in the dispersion room, they are classified as they are. Therefore, toner particles with fine particles adhered thereto are classified as they are although the toner particles themselves have a proper particles size. The toner particles with fine particles adhered thereto are pulverized again together with large toner particles to be over-pulverized, and unnecessary fine particles increase, resulting in lowering of classifying efficiency.

Further, the incorporation of fine particles into a toner product is not ignored as the adhesion of fine particles to toner particles increases. The use of such toner product causes problems such as filming and fog.

In order to solve such problems as described above, Japanese Patent Laid-Open No. Hei 7-80415 discloses that more than two throttles or convexes are arranged in the direction towards pipe center from inner wall of raw material-supplying pipe so that aggregates of toner particles may be pulverized. As such, a classifier causes pressure loss, it is thus required to increase a capability of an air-flow generator above that necessary, resulting in a problem of effective throughput capacity.

SUMMARY OF THE INVENTION

The object of the present invention is to provide an air classifier which can pulverize aggregates of toner particles and fine particles effectively just before or after aggregates flow into a classifying body.

Another object of the present invention is to provide a production method of toner for electrophotography without problems, such as filming and fog, by use of the above air classifier.

The present invention relates to an air classifying system, comprising;

a supplying pipe for supplying raw materials, a truncated cone-like breather pipe, arranged in the supplying pipe, the opening area of which becomes smaller from upstream side to downstream side in the direction of air flow, a ratio of minimal opening sectional area $S_1$ to a maximum opening sectional area $S_0$ being between 0.2 and 0.5, and an angle θ formed between axis and generatrix being between 10° and 35°, a classifying means for classifying the raw materials supplied through the supplying pipe, an air flow-generating means for generating air-flow for transporting the raw materials in the classifying system.

The present invention also includes a toner produced by the above system.

DETAILED DESCRIPTION OF THE INVENTION

The present invention relates to an air classifying system, comprising;

a supplying pipe for supplying raw materials, a truncated cone-like breather pipe, arranged in the supplying pipe, the opening area of which becomes smaller from upstream side to downstream side in the direction of air flow, a ratio of minimal opening sectional area $S_1$ to a maximum opening sectional area $S_0$ being between 0.2 and 0.5, and an angle θ formed between axis and generatrix being between 10° and 35°, a classifying means for classifying the raw materials supplied through the supplying pipe, an air flow-generating means for generating air-flow for transporting the raw materials in the classifying system.

The present invention also includes a toner produced by the above system.

According to the present invention, a truncated cone-like breather pipe with specific shape is arranged in a raw material-supplying pipe in an immediate front position of a classifying body, thereby turbulence is generated without pressure loss, so that aggregates of toner particles and fine particles can be broken and dispersed at least in classifying room. Therefore, aggregates can be prevented from over-pulverization, resulting in prevention of increase of unnecessary fine particles and lowering of classifying efficiency. As proper classification of fine particles can be made in classifying area, incorporation of super fine particles into toner particles can be suppressed to minimal degree, so that particle size distribution of final toner product can be sharp. Therefore, it becomes possible to provide toner for electrophotography without problems, such as filming and fog.

Figure 1:
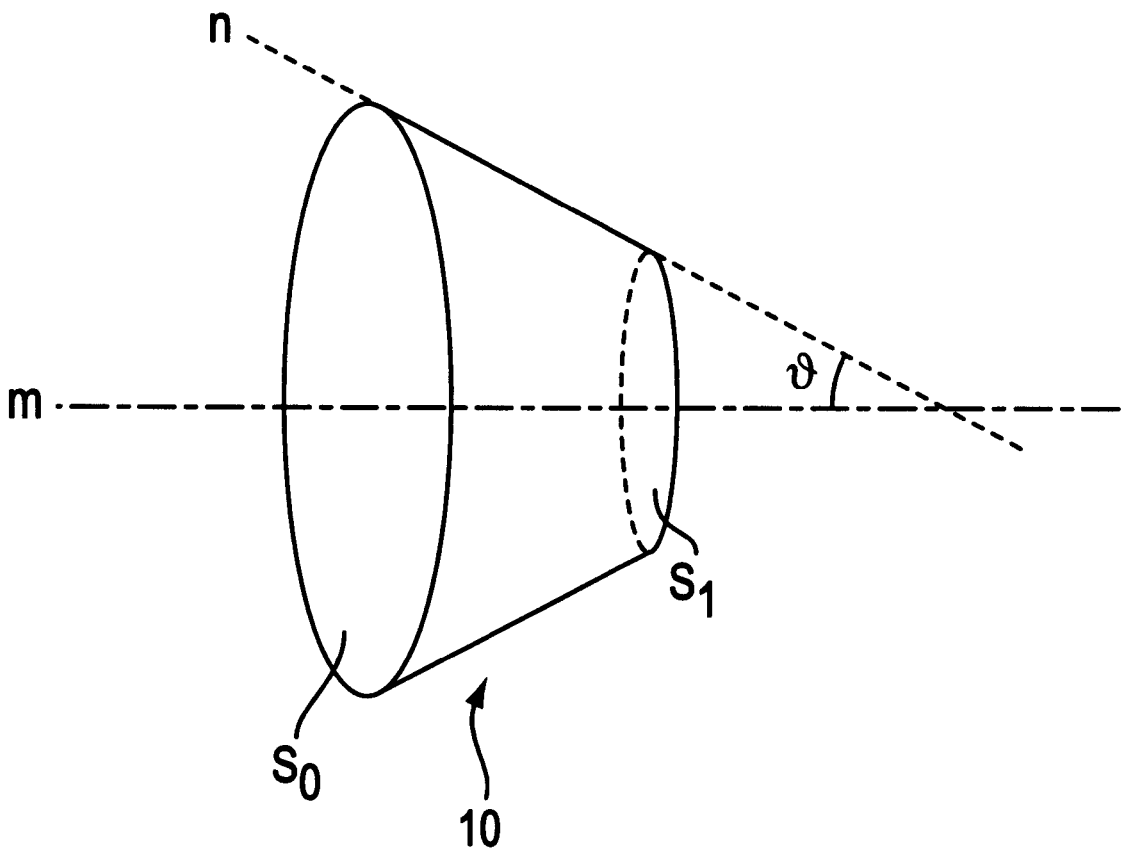
FIG. 1 is a perspective view of truncated cone-like breather pipe arranged in raw material-supplying pipe in air classifier.

The truncated cone-like breather pipe of the present invention has the shape shown in FIG. 1. A minimal opening sectional area $S_1$ of the breather pipe is 20–50%, preferably 30–50% of a maximum opening sectional area $S_0$. An angle θ formed between axis m and generatrix n is 10–35°, preferably 15–30°. If $S_1$ is smaller than 20% of $S_0$, pressure loss can not be ignored, and capability of a blower needs to be increased. If $S_1$ is larger than 50% of $S_0$, aggregates of toner particles etc. can hardly be broken, thus not providing the effects of the present invention. If the angle θ is smaller than 10°, aggregates of toner particles etc. can hardly be broken. If the angle θ is larger than 35°, pressure loss can not be ignored.

Figure 2:
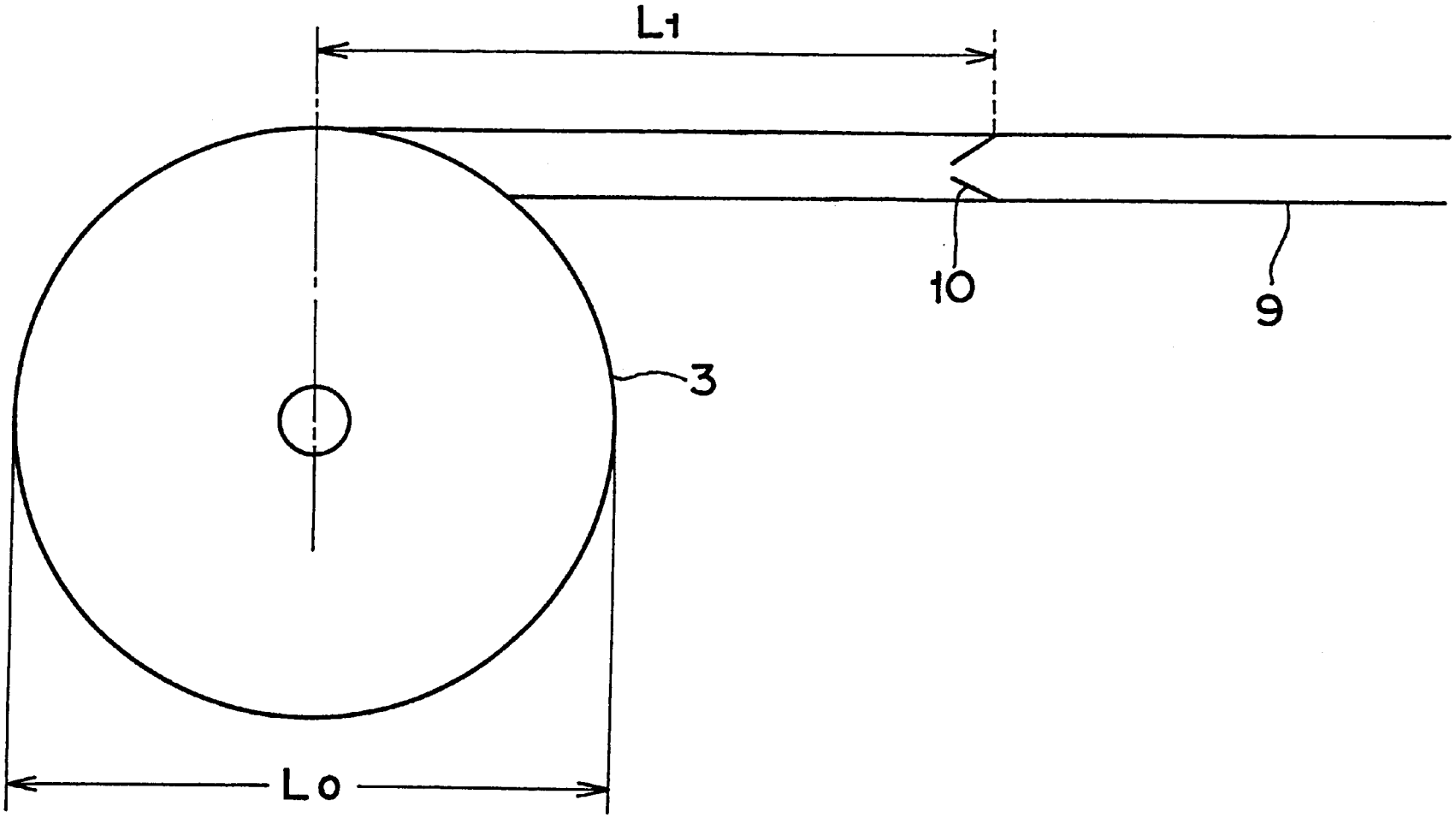
FIG. 2 is a schematic relation view of raw material-supplying pipe and truncated cone-like breather pipe when seen from right overhead of air classifier.

Mounting position of the breather pipe is explained in FIG. 2 which illustrates a schematic relation view of raw material-supplying pipe and truncated cone-like breather pipe when seen from right overhead of air classifier. The breather pipe is arranged at a position $L_1$ within $3L_0$ distance or less, preferably $2L_0$ distance or less, when a diameter of classifying body is $L_0$. If the distance is larger than $3L_0$, aggregates of toner particles etc. can hardly be broken, thus not providing the effect of the present invention. When the breather pipe is arranged within the above distance, plural breather pipes may be installed, but it is preferable that one or two breather pipes are arranged. It is most preferable to arrange one breather pipe. Such a breather pipe may be made of stainless steel, aluminum, iron, plastics, ceramics, rubber etc. Any other rigid material which can be processed easily may be used without limitation. Preferable materials are, however, stainless steel, aluminum and iron.

A sectional area of the raw material-supplying pipe with the truncated cone-like breather pipe installed therein is 20–120 $cm^2$, preferably 50–100 $cm^2$. If the sectional area is smaller than 20 $cm^2$, air flow rate is so high that fusion is caused. If the sectional area is larger than 120 $cm^2$, air flow rate is so low that transportation is not effective.

As above mentioned, the present invention is characterized in that the truncated cone-like breather pipe is arranged in the raw material-supplying pipe in an immediate front position of classifying body, thereby turbulence is generated without pressure loss, so that aggregates of toner particles and fine particles can be broken and dispersed to be classified. Therefore, any conventional air classifier may be used without limitation. Aggregates can be broken effectively when the aggregates flow at an air flow rate of 10 m/sec or more in the breather pipe. More effective flow rate is 20 m/sec or more.

The air classifier of the present invention may be applied to classify pulverized materials produced through conventional toner-producing steps of mixing raw materials for toner containing at least binder resin, colorant and charge controlling agent, melting and kneading the mixture, and pulverizing the kneaded materials.

Any known resin may be used as the binder resin, exemplifying styrene resins, acrylic resins, such as alkyl acrylates and alkyl methacrylates, styrene-acrylic copolymers, polyester resins, epoxy resins, silicone resins, olefin resins, and amide resins. These resins may be used singly or in combination.

Any known colorant may be used as the colorant without particular limitations. It is, however, preferable that colorants for color toner are subjected to master batch treatment or flashing treatment, so that the dispersibility of the colorants can be improved. A content of the colorants is preferably 2–15 parts by weight on the basis of 100 parts by weights of binder resin.

Any conventional charge controlling agent for electrophotography may be used as the charge controlling agent in the present invention. However, the air classifier of the present invention is particularly useful when toner contains an organic boron compound which remarkably causes secondary aggregation of toner particles after pulverization in toner production process, the organic boron compound being represented by the following general formula (I):

(I)

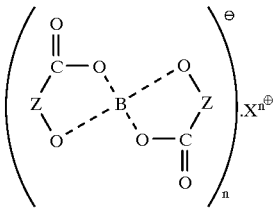

in which Z is a residual group forming a ring together with an oxygen atom and an carbon atom adjacent to Z; X represents a cation; and n represents an integer of 1 or 2 depending on a valence of X.

The Z group in the general formula (I) of the organic boron compound is represented by the following formulas:

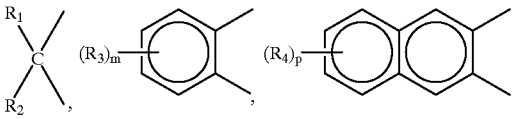

in which $R_1$ is a hydrogen atom, an alkyl group, or a substituted or nonsubstituted aryl group; $R_2$ is a substituted or nonsubstituted aryl group; $R_3$ is a hydrogen atom, an alkyl group, or an aryl group; m is an integer of 1–4; $R_4$ is a hydrogen atom, an alkyl group, or an aryl group; and p is an integer of 1–4.

Anions including the Z group in the organic boron compound may be exemplified by the following anions;

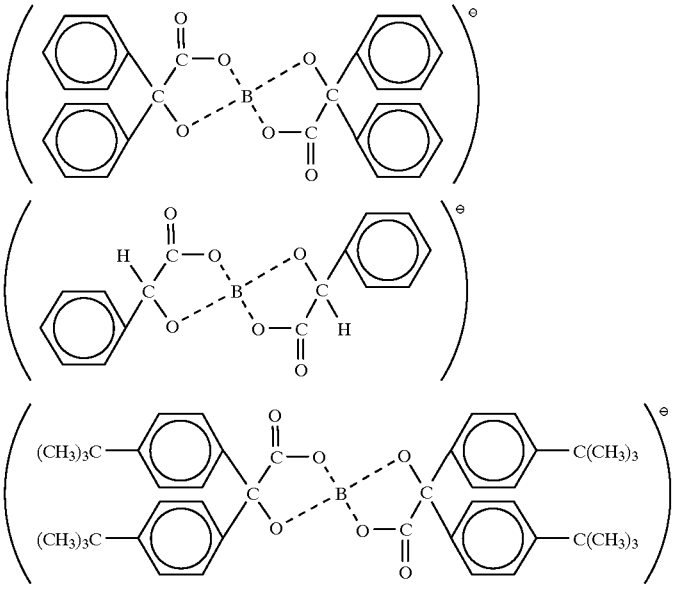

-continued
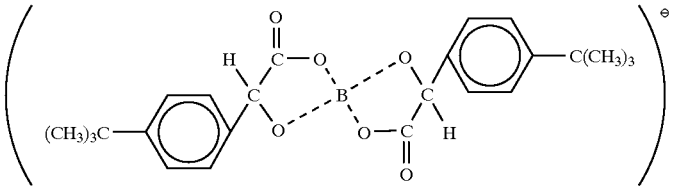
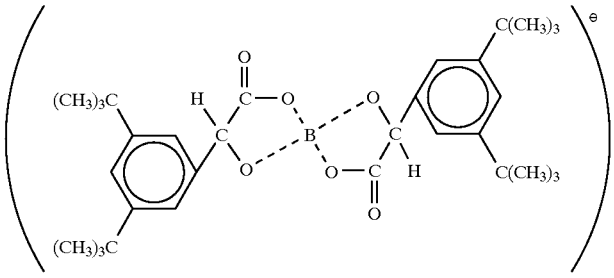
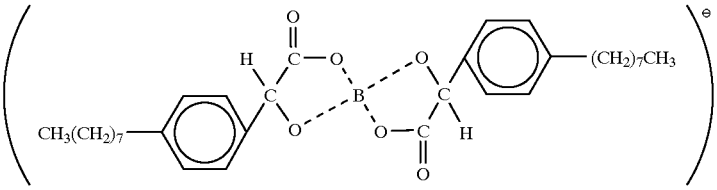
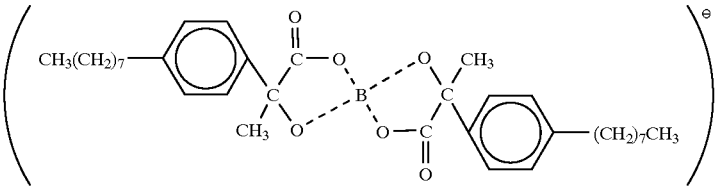
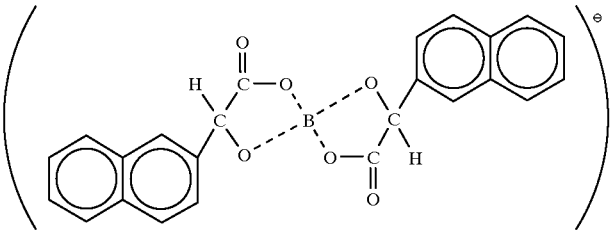
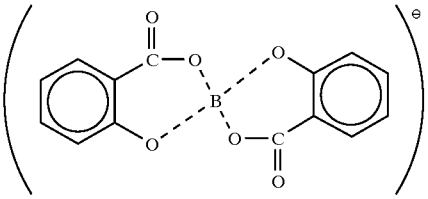
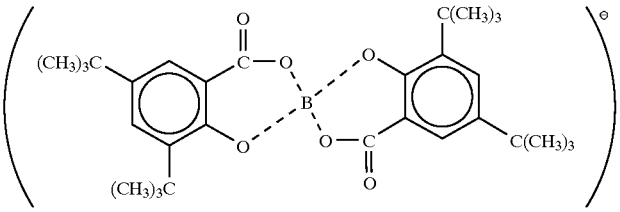
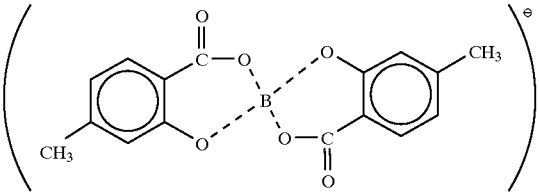

-continued

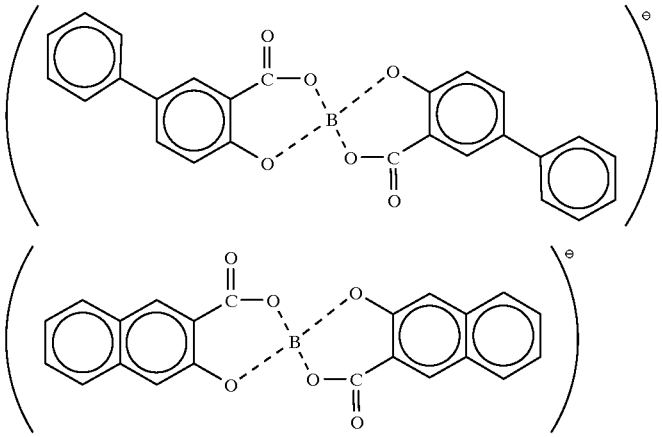

The cation represented by $X^{n+}$ in the organic boron compound may be exemplified by inorganic cations, such as $H^+$, $Li^+$, $Na^+$, $K^+$, $Mg^{2+}$, $Ca^{2+}$ and $Zn^{2+}$, and organic cations, such as ammonium ion, iminium ion and phosphonium ion. Such concrete organic cations may be exemplified by the following:

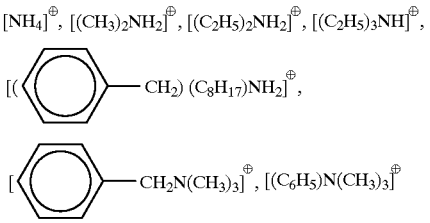

The organic boron compounds useful in the present invention may be the one in the combination of the above anion with the above cation. A content of charge controlling agent is 1–10 parts by weight on the basis of 100 parts by weight of binder resin.

It is preferable that metal oxide fine particles are contained internally in binder resin together with at least the colorant and the charge controlling agent in toner production process. When the metal oxide fine particles are contained at the time of mixing raw materials for toner, the fluidity of the mixture is improved in the mixing process before the kneading process. In particular, as the tackiness of the mixture, which is a problem caused when the organic boron compound is used, can be avoided, transportability of the mixture to the next process and productivity are is improved. Moreover, desired mixing can be achieved, and dispersibility of the materials can be improved, so that problems, such as filming and fog, can also be eliminated.

Silica, titania and alumina etc. may be used as the metal oxide fine particles contained internally in toner particles in the present invention. It is preferable that these metal oxide fine particles are surface-treated with a hydrophobic agent. When such surface-treated metal oxide fine particles are used, environmental stability is not deteriorated, exothermic heat is suppressed and dispersibility of charge controlling agent can be improved.

Silane coupling agents, titania coupling agents, silicone oil and silicone varnish may be used as the hydrophobic agents for surface-treating metal oxide fine particles. The silane coupling agents are exemplified by hexamethyldisilazane, trimethylsilane, trimethylchlrosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane. The silicone oil may be exemplified by dimethylpolysiloxane, methylhydrogenpolysiloxane and methylphenylpolysiloxane.

An addition the amount of the metal oxide fine particles contained internally in the toner particles is 0.05–3.0 parts by weight, preferably 0.1–1.0 parts by weight, more preferably 0.1–0.5 parts by weight on the basis of 100 parts by weight of binder resin. If the content is smaller than 0.05 parts by weight, addition effects above mentioned are insufficient. If the content is larger than 3.0 parts by weight, chargeability or fixability of toner particles may be deteriorated.

In the present invention, while binder resin is ground in a mixing machine, such as a Henschel mixer, which can generate shearing force, colorant and charge controlling agent are mixed and dispersed under stresses in the mixing process of raw materials. Other components added in this process may be exemplified by waxes and magnetic particles. It is preferable from an economic viewpoint that super fines produced in the pulverizing and/or classifying process during toner production are recycled to be used in the mixing process.

In the mixing process, all raw materials may be mixed at the same time, or each raw material may be added step by step. It is, however, preferable that the super fines are mixed after the other materials are mixed. The reason is as follows. It is required that raw materials, such as colorant and charge controlling agent, are dispersed uniformly. When super fines are added at the same time when the other materials are added, the super fines work as a cushioning material because of their very small particle size. Stresses caused by binder resin are hardly given to those materials other than super fines, so that complete dispersion and mixing may not be achieved.

The obtained mixture is provided for a conventional melting and kneading process. After the kneaded material is cooled, it is transferred to a pulverizing process. In the melting and kneading process, a conventional monoaxial or biaxial kneading extruder may be used, so that a binder-resin and components compatible with the resin can be melted, or so that components, such as a charge controlling agent, incompatible with the binder resin can be dispersed uniformly in the binder resin. The kneaded materials are pulverized and classified to give toner particles having a volume mean particle size of 5–10 $\mu$m, preferably 6–9 $\mu$m. If the particle size is less than 5 $\mu$m, it becomes hard to handle the toner particles in machines. If the size is more than 10 $\mu$m, reproducibility of fine images are deteriorated. In the pulverizing process, the kneaded materials are first pulverized roughly by a feather mill etc., and then pulverized finely by a jet mill etc. in order to obtain a desired particle size.

Figure 3:
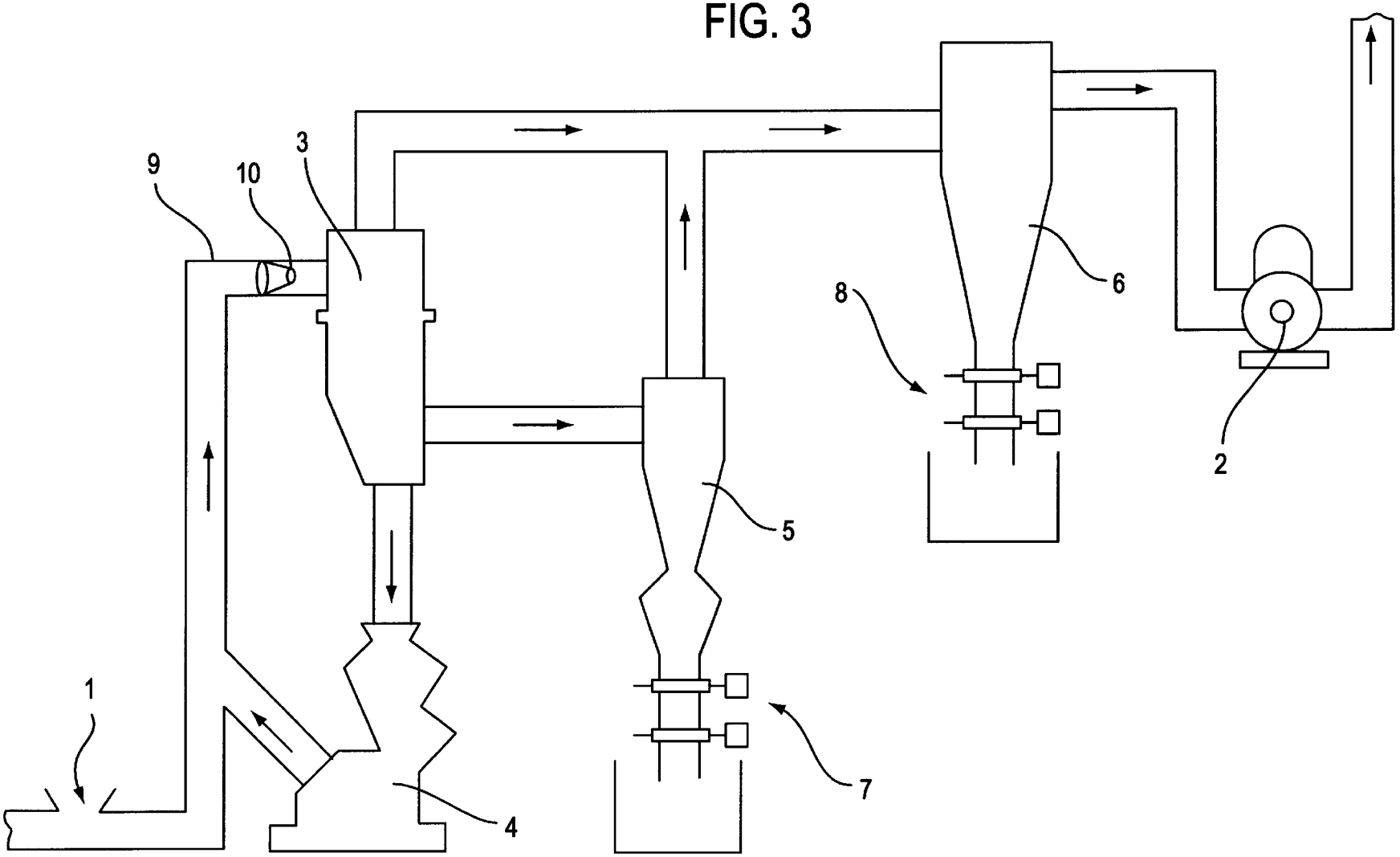
FIG. 3 is a schematic view of one example of pulverizing and classifying system using air classifier of the present invention.
Figure 4:
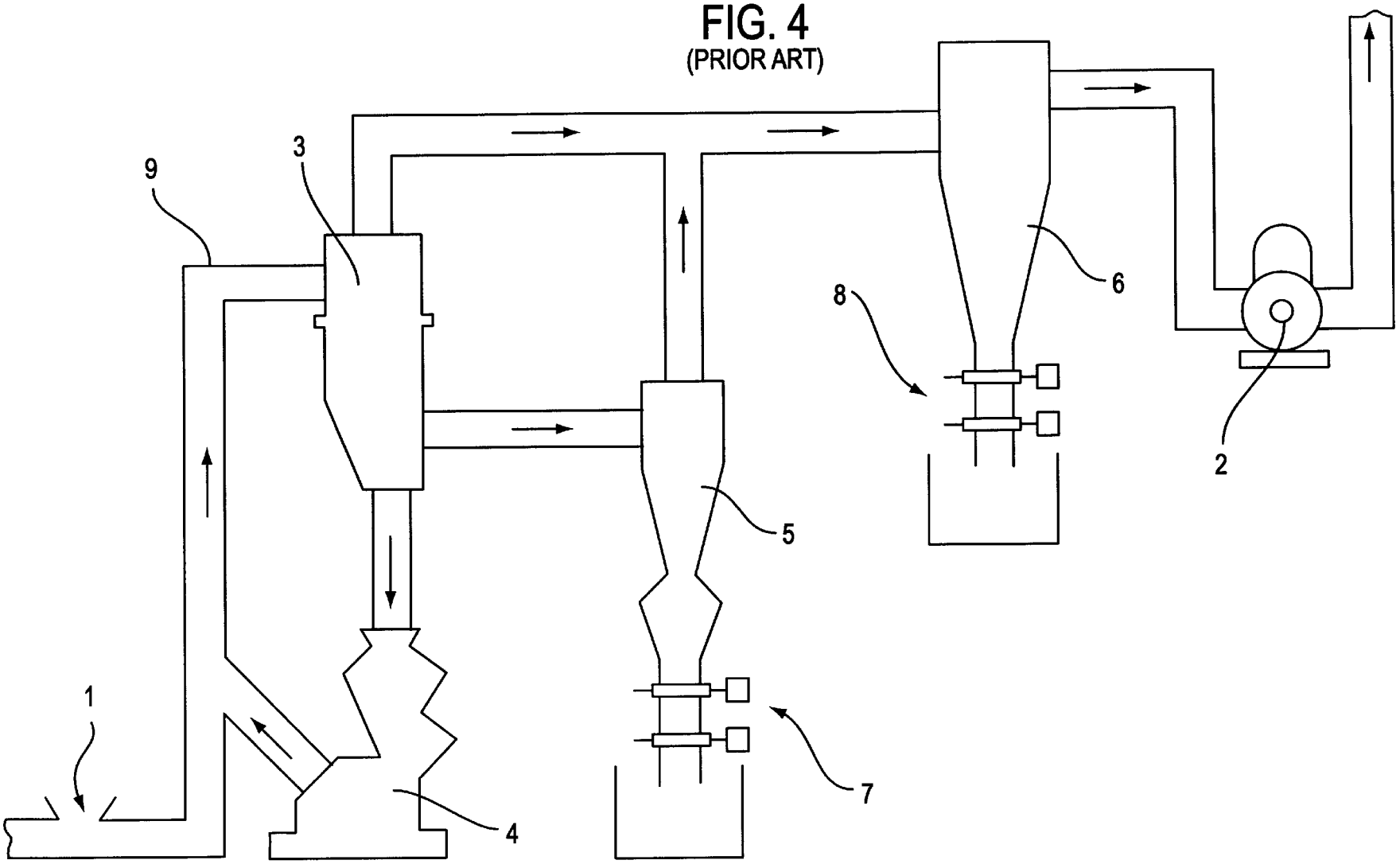
FIG. 4 (PRIOR ART)
FIG. 4 is a schematic view of one example of conventional pulverizing and classifying system.
Figure 5:
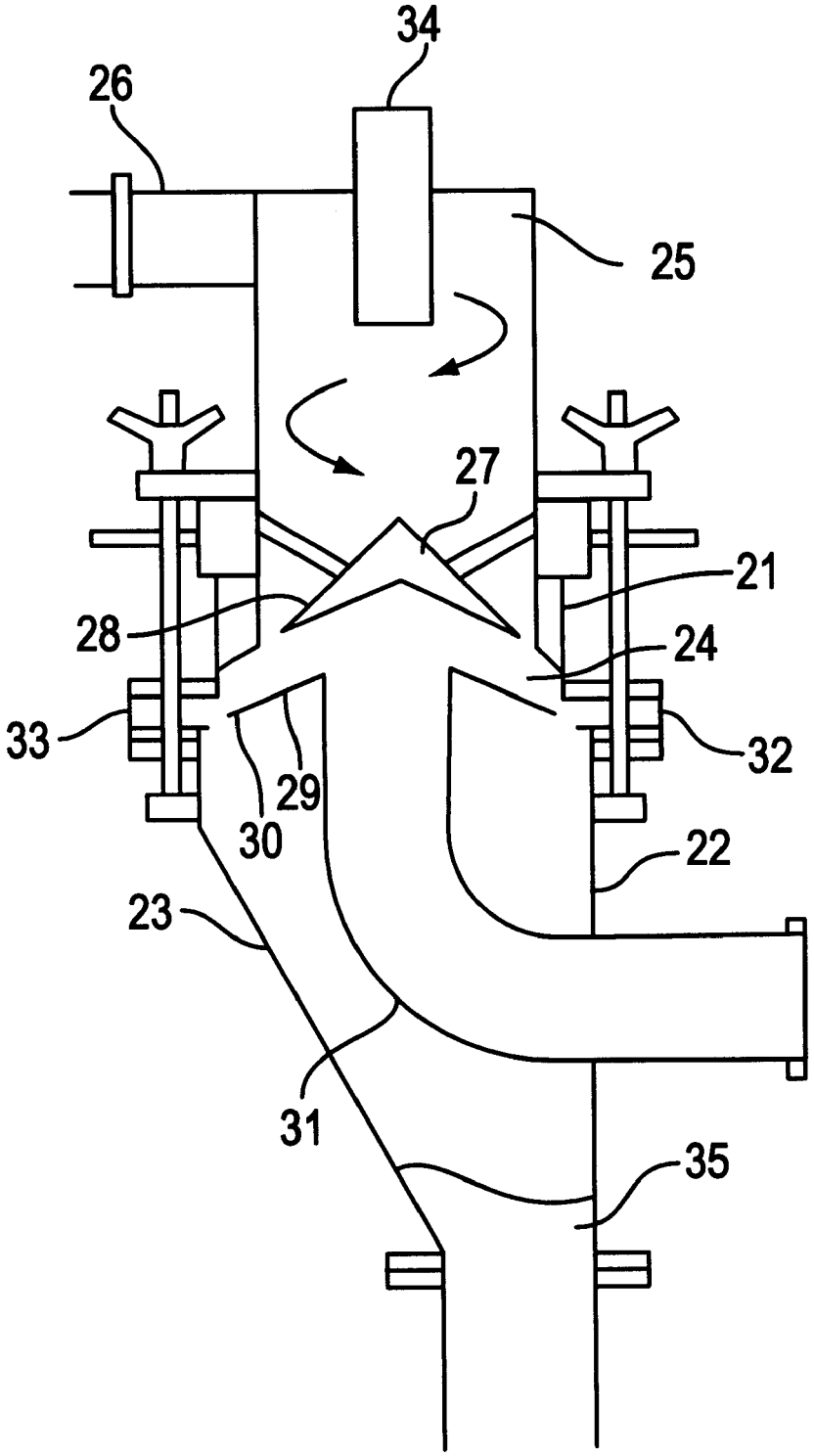
FIG. 5 (PRIOR ART)
FIG. 5 is a schematic sectional view of air classifier utilizing swirling air flow.

For example, coarsely pulverized materials are supplied to a pulverizing and classifying process in which a finely pulverizing process and a classifying process of the present invention are carried out continuously as shown in FIG. 3. The coarsely pulverized materials are introduced into an introduction port 1 after melting and kneading. Inside-air of pipelines is sucked by a blower 2 to generate air flow in the direction as shown by arrows. The coarsely pulverized materials ride on the air flow and are transported to a dispersion room in the air classifier body of the present invention. A truncated cone-like breather pipe 10 generates turbulence to break aggregates of toner particles etc., so that toner particles are dispersed. Toner particles having a particle size larger than a desired particle size are transported to a pulverizer 4. Toner particles having a desired particle size are transported to a cyclone 5. Super fines are transported to a bag filter 6. Thus, classification is precisely made. Since the initially roughly-pulverized materials have a large particle size, almost all of those particles are transferred to the pulverizer 4. The toner particles that have been finely pulverized in the pulverizer 4 are then transported again to a classifier main body 3 through a supplying pipe 9 having the breather pipe 10 and subjected to the above mentioned classification. The toner particles having a large particle size are repeatedly pulverized and classified until desired particle size is achieved. Then the toner particles having desired particle size are transferred to the cyclone 5 and collected. Super fine particles are transferred to the bag filter 6, although some toner particles transferred to the cyclone 5 contain super fine particles not removed in the classifier 3.

Toner particles collected in the cyclone 5 are accumulated on the upper part of double dampers 7. While the downside valve is closed, the upside valve is opened, so that toner particles fall onto the downside valve. After the upside valve is closed, the down side valve is opened. Thereby, while the conditions of air flow inside the pipelines are maintained, toner particles can be taken out of the inside. Double dampers 8 are also arranged at the lower portion of the bag filter. Super fines collected in the bag filter 6 can be taken out of the inside while the air-flow conditions inside pipe lines are maintained.

It is preferable that toner particles obtained through the above processes are added externally with metal oxide fine particles in order to improve fluidity and environmental stability. It is preferable that those metal oxide fine particles are hydrophobically treated. Preferred meal oxide is silica or titania.

A content of the metal oxide fine particles added externally to the toner particles is 0.1–3.0% by weight, preferably 0.5–2.5% by weight. If addition is less than 0.1% by weight, effects achieved by its addition are insufficient. If addition is larger than 3% by weight, the increase of metal fine particles passing at the time of blade cleaning process causes image noise.

The toner particles thus obtained are dispersed because aggregates of toner particles etc. are broken by the air classifier of the present invention in the classifying process. Therefore, few super fine particles are incorporated in the obtained toner particles. There arises no problem, such as filming and fog. It can be avoided that although toner particles themselves have a proper particles size, the toner particles with fine particles adhered thereto are pulverized again together with large toner particles to be over-pulverized, resulting in remarkable improvement of classifying efficiency compared to the conventional process. Further, as toner particles having small particle size and narrow particle size-distribution can easily be obtained, the toner particles are suitable for forming copy images with high and precise resolution, as required recently.

The toner obtained according to the present invention may be used as a toner in tow-component developer or in one-component developer.

The present invention is further explained by examples.

EXAMPLE

Synthesis of Polyester Resin A

| | molar ratio |
|---|---|
| polyoxypropylene(2,2)-2,2-bis-(4-hydxyphenyl)propane (PO) | 3 |
| polyoxyethylene(2,0)-2,2-bis-(4-hydxyphenyl)propane (EO) | 7 |
| terephthalic acid (TPA) | 9 |

Four-necked 5-liter flask equipped with a reflux condenser, a water-separator, a nitrogen-gas inlet pipe, a stirrer and a thermometer was set on a mantle heater. The above ingredients were put into the flask at the above molar ratio. The materials were stirred and heated to be reacted with nitrogen gas introduced into the flask. The reaction was chased while an acid value was measured. The reaction was finished at the time a predetermined acid value was reached. Thus, polyester resin A was obtained. This resin had Tg of 65° C.

Preparation of Pigment Master Batch

| | weight ratio |
|---|---|
| polyester resin A (Tg = 65° C.) | 7 |
| cyan pigment | 3 |
| (C.I.pigment blue 15-3; made by Toyo Ink Seizou K.K.) | |

The above materials were supplied to a press kneader at the above weight ratio while heat and pressure were applied, so that the pigment could be kneaded and dispersed sufficiently. The kneaded materials were cooled and pulverized by a feather mill to give a pigment master batch.

Example 1

| | |
|---|---|
| • polyester resin A (Tg = 65° C.) | 80 pbw |
| • pigment master batch | 20 pbw |
| • charge controlling agent | 2 pbw |
| (organic boron compound represented by the following formula (II): | |

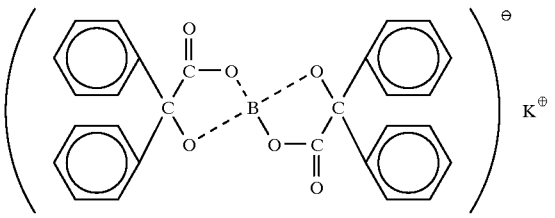

(II)

The above ingredients were put into Henschel mixer so that the resin and the other materials were mixed uniformly (first mixing process). The obtained mixture was further added with 20 parts by weight of recycled super fines (produced in pulverizing and classifying processes) and 0.2 parts by weight of hydrophobic silica (H-2000; made by Hoechst Co.) to be mixed again (second mixing process).

The mixture obtained in the second mixing process was put into a biaxial kneading extruder to be kneaded uniformly. The kneaded and discharged materials were left standing to be cooled sufficiently. The cooled materials were coarsely pulverized and supplied to the pulverizing and classifying system shown in FIG. 3. Fine pulverization was made in a jet pulverizer. Classification was made in an air classifier equipped with a truncated cone-like breather pipe having the shape in FIG. 1 and FIG. 2 as shown below. The toner particles obtained had a mean particle size of 8.3 μm. The toner particles were surface-treated with 0.3% by weight of hydrophobic silica (H-2000; made by Hoechst Co. specific surface area: 150 $m^2$ /g, hydrophobicity: 55%) and further surface-treated with 0.2% by weight of hydrophobic titania (T-805; made by Aerosil K.K.; specific surface area: 35 $m^2$/g, hydrophobicity: 55%). Thus toner A was obtained.

(truncated cone-like breather pipe)

$\theta=22°$ $S_1/S_0=0.5$ $L_0=288$ mm $L_1=150$ mm $=0.52L_0$

Example 2

| | |
|---|---|
| polyester resin A (Tg = 65° C.) | 100 pbw |
| charge controlling agent | 2 pbw |
| (organic boron compound represented by the above formula (II)) | |

The above ingredients were put into Henschel mixer so that the charge controlling agent could be mixed uniformly (first mixing process). The obtained mixture was further added with 7 parts by weight of carbon black (MA#8; made by Mitsubishi Kogyo K.K.), 20 parts by weight of recycled super fines (produced in pulverizing and classifying processes) and 0.2 parts by weight of hydrophobic silica (H-2000; made by Hoechst Co.) to be mixed again (second mixing process).

Toner particles having a mean particle size of 8.2 μm were obtained in a manner similar to Example 1, except that the arranging position of a truncated cone-like breather pipe in the air classifier is 300 mm ($L_1$=300 mm=1.04$L_0$). The toner particles were surface-treated with 0.5% by weight of hydrophobic silica (H-2000; made by Hoechst Co.) to give toner B.

Example 3

| | |
|---|---|
| thermoplastic styrene-acrylic resin (Tg = 64° C.) | 100 pbw |
| charge controlling agent | 2 pbw |
| (Nigrosine base; made by Orient Kagaku Kogyo K.K.) | |
| carnauba wax (made by Kato Yoko K.K.) | 3.5 pbw |

The above ingredients were put into Henschel mixer so that the charge controlling agent could be mixed uniformly (first mixing process). The obtained mixture was further added with 7 parts by weight of carbon black (MA#8; made by Mitsubishi Kogyo K.K.), and 20 parts by weight of recycled super fines (produced in pulverizing and classifying processes) to be mixed again (second mixing process).

Toner particles having a mean particle size of 8.5 μm) were obtained in a manner similar to Example 1. The toner particles were surface-treated with 0.5% by weight of hydrophobic silica (H-2000; made by Hoechst Co.) to give toner C.

Example 4

Toner particles having a mean particle size of 8.4 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner D.

(truncated cone-like breather pipe)

$\theta=30°$ $s_1/S_0=0.3$ $L_0=288$ mm $L_1=150$ mm$=0.52L_0$

Example 5

Toner particles having a mean particle size of 8.2 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner E.

(truncated cone-like breather pipe)

$\theta=15°$ $S_1/S_0=0.5$ $L_0=288$ mm $L_1=150$ mm$=0.52L_0$

Example 6

Toner particles having a mean particle size of 8.3 μm were obtained in a manner similar to Example 1, except that two truncated cone-like breather pipes were arranged at 150 mm ($L_1=150$ mm$=0.52L_0$) and at 300 mm ($L'_1=300$ mm$=1.04L_0$) in the Classifier. The toner particles were surface-treated with 0.5% by weight of hydrophobic silica (H-2000; made by Hoechst Co.) to give toner F. At this time, an opening degree of damper for adjusting automatically an air-flow amount of the blower was 70%. There was enough power to spare.

Example 7

Toner particles having a mean particle size of 8.3 μm) were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner G.

(truncated cone-like breather pipe) $\theta=10°$ $S_1/S_0=0.5$ $L_0=288$ mm $L_1=150$ mm$=0.52L_0$ Example 8

Toner particles having a mean particle size of 8.2 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner H (truncated cone-like breather pipe)

$\theta=35°$ $S_1/S_0=0.5$ $L_0=288$ mm $L_1=150$ mm $0.52L_0$

Example 9

Toner particles having a mean particle size of 8.2 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner I (truncated cone-like breather pipe)

$\theta=22°$ $S_1/S_0=0.2$ $L_0=288$ mm $L_1=150$ mm$=0.52L_0$

Comparative Example 1

Toner particles having a mean particle size of 8.4 μm were obtained in a manner similar to Example 1, except that a truncated cone-like breather pipe was not arranged in the air classifier. The toner particles were surface-treated with 0.5% by weight of hydrophobic silica (H-2000; made by Hoechst Co.) to give toner J.

Comparative Example 2

Toner particles having a mean particle size of 8.6 μm were obtained in a manner similar to Example 3, except that a truncated cone-like breather pipe was not arranged in the air classifier. The toner particles were surface-treated with 0.5% by weight of hydrophobic silica (H-2000; made by Hoechst Co.) to give toner K.

Comparative Example 3

Toner particles having a mean particle size of 8.5 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner L.

(truncated cone-like breather pipe)

$\theta=40°$ $S_1/S_0=0.5$ $L_0=288$ mm $L_1=150$ mm $=0.52L_0$

Comparative Example 4

Toner particles having a mean particle size of 8.5 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner M.

(truncated cone-like breather pipe)

$\theta=5°$ $S_1/S_0=0.5$ $L_0$=288 mm $L_1$=150 mm=0.52$L_0$

Comparative Example 5

Toner particles tried to be obtained in a manner similar to Example 1, except that the arranging position and shape conditions of a truncated cone-like breather pipe in the air classifier were set as below. But, pressure loss was too large to get output of blower enough to make classification.

(truncated cone-like breather pipe)

θ=22°

$S_1/S_0$=0.1

$L_0$=288 mm $L_1$=150 mm=0.52$L_0$

Comparative Example 6

Toner particles having a mean particle size of 8.4 μm were obtained in a manner similar to Example 1, except that the arranging position and shape conditions of a truncated cone-like breather pipe in the air classifier were set as below. The toner particles were surface-treated with 0.5% by weight of hydrophobic silica (H-2000; made by Hoechst Co.) to give toner N.

(truncated cone-like breather pipe)

θ=22°

$S_1/S_0$=0.6

$L_0$=288 mm $L_1$=150 mm=0.52$L_0$

The production conditions of toners A-N were summarized in Table 1. A ratio (% by weight) of toner particles having a particle size of 12.7 μm or more and a ratio (% by weight) of toner particles having a particle size of 5.0 μm or less were measured by Multisizer with respect to each toner. A ratio (yield) of weight of obtained toner particles having a desired particle size to weight of coarsely pulverized materials supplied to the fine pulverization and classification system was calculated. The results were summarized in Table 2.

TABLE 1

| Ex *1/ CEx *2 | toner | | binder resin | truncated cone-like breather pipe Θ (°) | $S_1/S_0$ | $L_1$ (mm) |
|---|---|---|---|---|---|---|
| Ex 1 | A | Color | PES | 22 | 0.5 | 150 |
| Ex 2 | B | black | PES | 22 | 0.5 | 300 |
| Ex 3 | C | black | St-Ac | 22 | 0.5 | 150 |
| Ex 4 | D | color | PES | 30 | 0.3 | 150 |
| Ex 5 | E | color | PES | 15 | 0.5 | 150 |
| Ex 6 | F | color | PES | 15 | 0.5 | 150, 300 |
| Ex 7 | G | color | PES | 10 | 0.5 | 150 |
| Ex 8 | H | color | PES | 35 | 0.5 | 150 |
| Ex 9 | I | color | PES | 22 | 0.2 | 150 |
| CEx 1 | J | color | PES | — | — | — |
| CEx 2 | K | black | St-Ac | — | — | — |
| CEx 3 | L | color | PES | 40 | 0.5 | 150 |
| CEx 4 | M | color | PES | 5 | 0.5 | 150 |
| CEx 5 | — | color | PES | 22 | 0.1 | 150 |
| CEx 6 | N | color | PES | 22 | 0.6 | 150 |

PES = polyester resin (A) (Tg = 65° C.)
St-Ac = styrene-acrylic resin (Tg = 64° C.)
*1:Example
*2:Comparative Example

TABLE 2

| Ex *1/ CEx *2 | toner | mean particle size (μm) | particle size of 12.7 μm or more (wt%) | particle size of 0.5 μm or less (wt%) | yield (wt%) |
|---|---|---|---|---|---|
| Ex 1 | A | 8.3 | 1.3 | 8.8 | 82.9 |
| Ex 2 | B | 8.2 | 1.2 | 9.4 | 84.6 |
| Ex 3 | C | 8.5 | 1.6 | 8.3 | 83.1 |
| Ex 4 | D | 8.4 | 1.3 | 9.6 | 82.2 |
| Ex 5 | E | 8.2 | 1.2 | 7.9 | 85.1 |
| Ex 6 | F | 8.3 | 1.4 | 9.2 | 81.5 |
| Ex 7 | G | 8.3 | 1.9 | 9.5 | 80.4 |
| Ex 8 | H | 8.2 | 1.3 | 8.0 | 82.5 |
| Ex 9 | I | 8.2 | 1.2 | 7.8 | 84.5 |
| CEx 1 | J | 8.4 | 4.8 | 15.0 | 60.6 |
| CEx 2 | K | 8.6 | 4.6 | 14.7 | 62.2 |
| CEx 3 | L | 8.5 | 2.7 | 11.7 | 68.8 |
| CEx 4 | M | 8.5 | 3.2 | 13.5 | 61.2 |
| CEx 5 | — | | impossible to classify | | |
| CEx 6 | N | 8.4 | 2.5 | 11.5 | 70.2 |

*1:Example
*2:Comparative Example

Durability Test With Respect to Copy

Toners A, B, D, E, F and J were respectively put into a modified electrophotographic printer SP1000 (system speed: 35 mm/sec) (made by Minolta K.K.). Copying process was repeated continuously 6000 times. Filming on the photosensitive member and fog in copied images were evaluated after 3000 times of copy and 6000 times of copy. The results were shown in Table 3. The evaluation was ranked as follows.

Filming on Photosensitive Member;

◎: No filming.

○: A little filming, being no problem on practical use.

Δ: Fog caused by filming were partially observed, being a problem on practical use.

x: Filming was observed and lowering of sensitivity of photosensitive member caused fog.

Fog;

○: No fog

Δ: Fog was partially observed in copied images, being a problem on practical use.

x: Fog was formed.

TABLE 3

| Ex *1/ CEx *2 | toner | durability with respect to copy after 3000 times of copy: filming on PSM | fog | durability with respect to copy after 6000 times of copy: filming on PSM | fog |
|---|---|---|---|---|---|
| Ex 1 | A | ◎ | ○ | ◎ | ○ |
| Ex 2 | B | ◎ | ○ | ◎ | ○ |
| Ex 4 | D | ◎ | ○ | ◎ | ○ |
| Ex 5 | E | ◎ | ○ | ◎ | ○ |
| Ex 6 | F | ◎ | ○ | ◎ | ○ |
| CEx 1 | J | Δ | × | × | × |
| CEx 3 | L | ○ | Δ | × | × |

PSM = phosensitive member
*1:Example
*2:Comparative Example

With respect to toners A and K, each toner was mixed sufficiently with a binder type carrier (mean particle size of 65 μm) to be electrically charged. Copying process was repeated continuously 60000 times by a copying machine EP410Z (made by Minolta K.K.). Filming and black spots (BS) on the photosensitive member were evaluated after 30000 times of copy and 60000 times of copy. The results were shown in Table 4. The evaluation was ranked as follows.

Filming on Photosensitive Member;

⊙: No filming.

○: A little filming, being no problem on practical use.

Δ: Fog caused by filming was partially observed, being a problem on practical use.

x: Filming was observed and lowering of sensitivity of photosensitive member caused fog.

BS;

○: No BS.

Δ: BS was observed on photosensitive member, but no BS in copied images, being no problem on practical use.

x: BS was formed in copied images.

TABLE 4

| | | durability with respect to copy after 30000 times of copy | | durability with respect to copy after 60000 times of copy | |
|---|---|---|---|---|---|
| Ex *1/ CEx *2 | toner | filming on PSM | BS | filming on PSM | BS |
| Ex 3 | C | ⊙ | ○ | ⊙ | ○ |
| CEx 2 | K | Δ | Δ | × | × |

PSM = phosensitive member
*1:Example
*2:Comparative Example

The toner produced through the classifying process according to the present invention shows high yield and a sharp particle-size distribution compared to toner produced by a method other than the present invention. There was no problem on filming and fog. It is thought that the air classifier of the present invention can break aggregated toner particles well to be classified.

Effects of the Present Invention

The toner obtained through the classifying process according to the present invention contains few fine particles and has a narrow particle-size distribution, resulting in no problem on filming and fog. The present invention can meet recent requirements of copy images with high and precise resolution. The air classifier of the present invention is particularly useful to toner particles containing an organic boron compound which have strong aggregation properties as a charge controlling agent, and can produce toner particles having a desired particle size and a narrow particle-size distribution. Further, the air classifier of the present invention shows low pressure loss, so that effective and precise classification can be carried out.

What is claimed is:

1. An air classifying system, comprising;

a supplying pipe for supplying raw materials, a truncated cone-like breather pipe, arranged in the supplying pipe, the opening area of which becomes smaller from upstream side to downstream side in a direction of air flow, a ratio of minimal opening sectional area $S_1$ to a maximum opening sectional area $S_0$ being between 0.2 and 0.5, and an angle θ formed between axis and generatrix being between 10° and 35°, a classifying means for classifying the raw materials supplied through the supplying pipe, an air flow-generating means for generating air-flow for transporting the raw materials in the classifying system.

2. An air classifying system of claim 1, in which the raw materials contain a binder resin, a colorant and a charge controlling agent, being for a toner for electrophotography.

3. An air classifying system of claim 2, in which the charge controlling agent is an organic boron compound represented by the following formula (I):

(I)

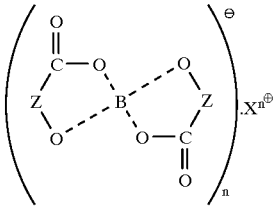

in which Z is a residual group forming a ring together with an oxygen atom and an carbon atom adjacent to Z.; X represents a cation; and n represents an integer of 1 or 2 depending on a valence of X.

4. An air classifying system of claim 1, in which the air flow-generating means generates air flow sucking the raw materials supplied in the supplying pipe toward the classifying means to transport the raw materials to the classifying means.

5. An air classifying system of claim 1, in which the ratio of minimal opening sectional area $S_1$ to a maximum opening sectional area $S_0$ being between 0.3 and 0.5.

6. An air classifying system of claim 1, in which the angle θ formed between axis and generatrix is between 15° and 30°.

7. An air classifying system of claim 1, in which the classifying means comprising;

a cylindrical casing, an opening arranged on the cylindrical casing, and connected to the supplying pipe through which the raw materials are supplied, a conical member, arranged in the casing, and working to make the air flow whirl inside the casing so that the raw materials can be classified by centrifugal force of the whirling flow.

8. An air classifying system of claim 7, in which the supplying pipe is straightly connected to the classifying means and the truncated cone-like breather is arranged at $3L_0$ position, wherein $L_0$ is a diameter of the casing of the classifying means, from the casing in the supplying pipe.

9. An air classifying system of claim 1, in which the number of the truncated cone-like breather arranged in the supplying pipe is plural.

10. An air classifying system of claim 1, in which a sectional area of the supplying pipe is 20–120 $cm^2$.

11. An air classifying system of claim 1, in which a sectional area of the supplying pipe is 50–100 $cm^2$.

12. An air classifying system of claim 1, in which a flow rate of the air flow inside the supplying pipe is 10 m/sec or more.

13. An air classifying system, comprising;

a supplying pipe for supplying raw materials, a truncated cone-like breather pipe, arranged in the supplying pipe, the opening area of which becomes smaller from upstream side to downstream side in a direction of air flow, a ratio of minimal opening sectional area $S_1$ to a maximum opening sectional area $S_0$ being between 0.2 and 0.5, and an angle θ formed between axis and generatrix being between 10° and 35°, a classifying means for classifying the raw materials supplied through the supplying pipe, a first collecting apparatus connected to the classifying means, in which raw materials classified by the classifying means and having a desired specific gravity are collected, a second collecting apparatus connected to the classifying means, in which raw materials classified by the classifying means and having a specific gravity less than desired are collected, an air flow-generating means for generating air-flow for transporting the raw materials in the classifying system.

14. An air classifying system of claim 13, further comprising;

a pulverizing apparatus in which the raw materials classified by the classifying means and having a desired specific gravity are pulverized after collected by the first collecting apparatus; and a path connected from the pulverizing apparatus to a upstream side of the truncated cone-like breather pipe in the direction of the air flow, through which the raw materials pulverized in the pulverizing apparatus is supplied again to the upstream side of the truncated cone-like breather pipe.

15. An air classifying system of claim 13, in which the raw materials contain a binder resin, a colorant and a charge controlling agent, being for a toner for electrophotography.

16. An air classifying system of claim 15, in which the charge controlling agent is an organic boron compound represented by the following formula (I):

(I)

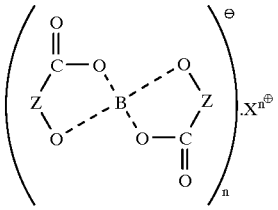

in which Z is a residual group forming a ring together with an oxygen atom and an carbon atom adjacent to Z; X represents a cation; and n represents an integer of 1 or 2 depending on a valence of X.

* * * * *

UNITED STATES PATENT AND TRADEMARK OFFICE

CERTIFICATE OF CORRECTION

PATENT NO. : 5,921,481

DATED : July 13, 1999

INVENTORS : Nakamura et al.

It is certified that error appears in the above-identified patent and that said Letter Patent is hereby corrected as shown below:

Claim 3, line 23, change ".$X^{n\oplus}$" to --·$X^{n\oplus}$--; and
line 29, change "Z.;" to --Z;--.

Claim 16, line 23, change ".$X^{n\oplus}$" to --·$X^{n\oplus}$--

Signed and Sealed this

Fourteenth Day of December, 1999

*Attest:*

Q. TODD DICKINSON

*Attesting Officer*

*Acting Commissioner of Patents and Trademarks*